United States Patent [19]

Korwin

[11] 4,316,645

[45] Feb. 23, 1982

[54] PILFER-PROOF PRECIOUS METAL FILINGS COLLECTION BOX

[76] Inventor: Richard M. Korwin, 404 E. 66th St., New York, N.Y. 10021

[21] Appl. No.: 152,359

[22] Filed: May 22, 1980

[51] Int. Cl.[3] ..... A47B 88/00

[52] U.S. Cl. ..... 312/212; 312/229; 312/322; 209/374; 51/270

[58] Field of Search ..... 312/322, 212, 229; 51/270; 209/371, 373, 374, 239

[56] References Cited

U.S. PATENT DOCUMENTS

| | | | |
|---|---|---|---|
| 169,651 | 11/1875 | McClurg | 312/322 |
| 303,197 | 8/1884 | Watson et al. | 209/374 |
| 527,589 | 10/1894 | Bristol | 312/212 |
| 890,005 | 6/1908 | Wright | 51/270 |
| 1,255,040 | 1/1918 | Ousley | 51/270 |
| 1,340,213 | 5/1920 | Burnett | 51/270 |
| 1,374,075 | 4/1921 | Graham | 51/270 |
| 1,390,455 | 9/1921 | McCollom | 209/374 |
| 2,660,313 | 11/1953 | James | 312/229 |
| 3,100,474 | 8/1963 | Schneider | 209/374 |
| 3,592,521 | 7/1971 | Cox | 312/222 |

*Primary Examiner*—Victor N. Sakran
*Attorney, Agent, or Firm*—Berger & Palmer

[57] ABSTRACT

A precious metal filings collection box for use by jewelers or other tradesmen is disclosed which provides a pilfer-proof system for collection of precious metal filings which fall from jewelry or other articles as they are worked. The collection box is shown as being part of a jeweler's bench pan and is formed of a box-like unit having a screen mesh top through which the filings fall, but the openings of the screen are too small to permit the jeweler's hand or finger to pass therethrough. A locked bottom drawer which collects the filings is provided to prevent unauthorized removal of the precious metal filings.

1 Claim, 2 Drawing Figures

PILFER-PROOF PRECIOUS METAL FILINGS COLLECTION BOX

Background of the Invention

This invention relates to a pilfer-proof metal filings collection box, and more particularly, to a pilfer-proof box for a jeweler's bench pan.

Bench pans are conventionally of a box-like shape, adapted to slide on guides, as a drawer, so as to be stored-beneath the top of the work bench. These pans generally have a substantially open top with a small screen surface incorporated thereon of sufficient size to allow placement of tools used in conjunction with the work pan. Sometimes the work pan is removed to rest on the top of the jeweler, while it may also be hingedly connected to the table and swivel outwardly therefrom. As the jeweler works on the precious metal jewelry, filings fall therefrom onto the bench pan, and the filings are collected.

Due to the sudden and extreme rise in precious metal prices, epecially platinum, gold and silver, a need for ensuring that the jeweler does not remove these filings is required. The value of the filings can be enormous, considering the recently inflated prices of platinum, gold and silver. Therefore, companies employing jewelers are increasingly turning to different systems for ensuring that their employees do not remove precious metal filings.

Some of these systems relate to metal detectors, which involve the onerous invasion of privacy problems, where alarms are sometimes triggered erroneously. It is preferable to eliminate the possibility that employees can reach or take precious metal filings.

An object of the present invention is to provide a pilfer-proof precious metal filings collection box which may be readily adapted to catch precious metal filings, and yet prevent them from being removed from the collection means.

Another object of this invention is to provide a jeweler'bench pan employing the pilfer-proof system which is relatively similar in use in conventional bench pans, so as to eliminate the need to re-educate jewelers in the use of the pilfer-proof bench.

Yet another object of this invention is to provide such a bench pan which is relatively inexpensive to manufacture, easy to use, and secure.

Still another object of this invention is to provide such a jeweler's bench pan which provides for complete collection of the precious metal filings, yet prevents unauthorized access to the collection means.

Other objects, advantages and features of this invention will become more apparent from the following description.

SUMMARY OF THE INVENTION

In accordance with the principles of this invention, the above objects are accomplished by providing a jeweler's bench pan of a type over which a jeweler works on jewelry comprised of precious metal, the bench pan comprising a rigid frame to form a general box-like shape, with a top surface formed of a screen mesh, the top surface having openings therein to permit the precious metal particles or filings from the jewelry to fall through the screen and come to rest on a bottom collection drawer. The screen is recessed with regard to the top surface of the sides of the jeweler's bench pan, and the collection drawers provided with a lock so that the precious metal filings are held in the collection drawer until an authorized person opens the lock which opens the collection drawer.

The openings in the screen are sufficient to allow the passing of metal filings, yet are too small to allow the jeweler's hand to pass therethrough. Due to the distance between the screen and bottom of the collection drawer, the jeweler's finger cannot pass through the screen to reach the metal filings.

The jeweler's bench pan is adapted to be below the hands of the working jeweler, who will cause metal filings to fall through the mesh screen and rest in the collection drawer. In this fashion, the jeweler can work over a bench pan, which has a similar functional relationship to prior bench pans, but which now provides, for the first time, a pilfer-proof collection system for the metal filings.

DRAWING

DETAILED DESCRIPTION

Figure 1:
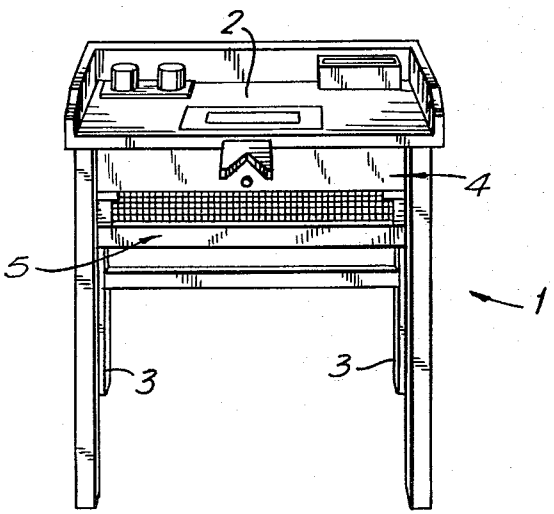
FIG. 1 is a perspective view of a jeweler's work bench including a bench pan.

FIG. 1 illustrates one type of conventional jewler's work bench 1 comprised of a hard top surface 2 generally formed of wood, such as maple, sturdy steel side legs 3—3, a drawer 4 and a bench pan 5. In this illustration, both the drawer 4 and bench pan 5 slide under the top on suitable drawer guides. In this manner, the work bench is conventional, and my invention will merely replace the prior jeweler's bench pan 5.

Figure 2:
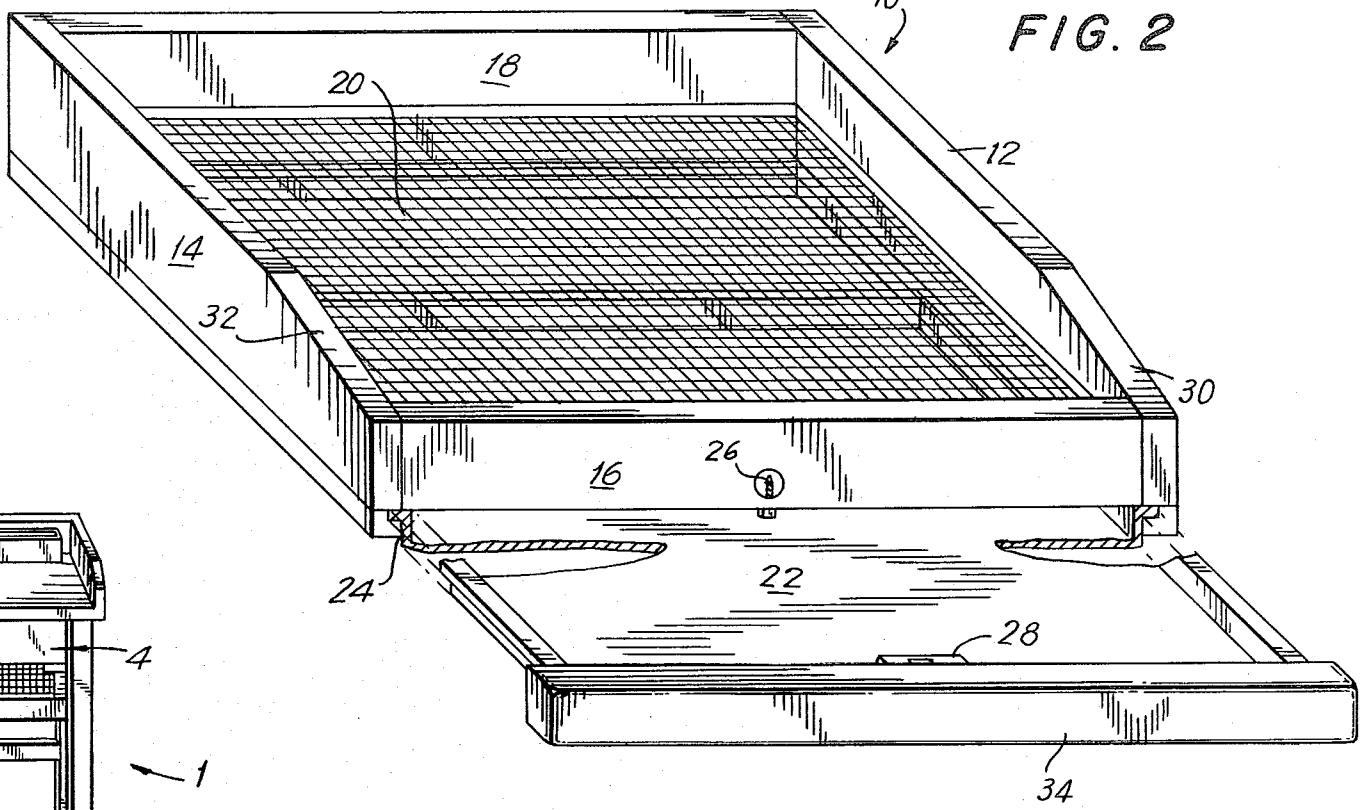
FIG. 2 is an exploded perspective view of the jeweler's pilfer-proof bench pan.

FIG. 2 is an exploded perspective view of my pilfer-proof collection box invention. The bench pan 10 is provided with parallel sides 12 and 14, and front and back planks, 16 and 18, respectively. The sides and planks are connected together to form a box-like structure having a rigid frame. A screen 20 totally covers the upper surface of the box, with the screen comprising a wire matrix of substantially thin wire forming an array of openings through which precious metal filings may pass, as they fall from an article of jewelry being worked on by the jeweler.

The bottom of the bench pan is formed of a collection drawer 22 adapted to be slideably inserted in a slide assembly 24 to form a closed front surface for the bench pan, when the collection drawer is in place.

A lock means is comprised of a lock 26 formed in the front plank 16 which cooperates with a latch 28 attached to the front plank of drawer 22, so that when the collection box is in place and the lock means is properly operated, the collection drawer will be locked. In this manner, the precious metal filings which fall through the screen will come to rest in the collection drawer and will remain there until an authorized person opens lock 26.

As stated above, screen 20 is recessed with regard to the top edges of sides 12 and 14 and front and rear plank 16 and 18, so as to ensure that metal filings do not accidentally slip over the side of the jeweler's bench pan as the jewelry is being manually worked. The top front surfaces 30 and 32 of sides 12 and 14 respectively are tapered downwardly to further enhance the functionality of the jeweler's bench pan.

In order to eliminate accidents, the front edges of the front plank 34 of the collection drawer are rounded to eliminate sharp edges.

As described, my invention represents a significant improvement in the art. Within the confines of designing a jeweler's bench pan to be substantially similar in look and function to prior bench pans, I have invented a novel security system in which the jeweler can work as he alway has, yet the employer need not wory that the jeweler will remove the metal filings unnoticed which conventionally fall to the bottom of the bench pan. The provision of a recessed metal screen preventing access to the filings, while permitting the jeweler to work in his normal fashion represents an improvement. Further, the provision of the locked collection drawer in which the metal filings are collected until an authorized person seeks to remove them also represents an advance over the art.

Additionally, the metal screen serves as a surface upon which the jeweler may place his tools without fear that the tools will slip or fall into the catachment area for the metal filings.

Although my invention has been described above with regard to a specific embodiment illustrated, departures therefrom may be made by those of ordinary skill in the art, while still encompassing the novel aspects and principals of my invention. For instance, the pilferproof collection box could be used with gliding wheels or other apparatus which are used to work on items made of precious metals, from which filings or particles fall off.

What is claimed is:

1. A jeweler's bench pan slideable into a drawer space along drawer guides in a jeweler's work bench, said jeweler's bench pan comprising four sides connected together and a screen connected between all four sides, said screen being connected to said four sides to be recessed with respect to the top of said four sides, said screen comprising openings of a size to permit jewelry filings and droppings to pass through but prevent insertion through said screen of the jeweler's fingers and hands, slide means formed along opposite side edges of said jeweler's bench pan allowing said jeweler's bench pan to slide along said drawer guides in said jeweler's work bench, said jeweler's work bench further comprising guide means formed along opposite side edges along the bottom of said jeweler's bench pan, a collection drawer forming the bottom surface of said jeweler's bench pan slideable along said guide means of said jeweler's work bench catching the jewelry droppings and filings, said collection drawer comprising lock means to lock said collection drawer into said jeweler's work bench to prevent unauthorized access to said jewelry filings and droppings, said screen being of sufficient strength to support the tools of a jeweler placed thereon.

* * * * *